US006682037B1

(12) United States Patent
Ouellette

(10) Patent No.: US 6,682,037 B1
(45) Date of Patent: Jan. 27, 2004

(54) CORNER PADDING ATTACHMENT DEVICE

(76) Inventor: Andre Ouellette, 137 Markland Crescent, Nepean, Ontario (CA), K2G 5Z8

( * ) Notice: Subject to any disclaimer, the term of this patent is extended or adjusted under 35 U.S.C. 154(b) by 0 days.

(21) Appl. No.: 10/321,753

(22) Filed: Dec. 18, 2002

(51) Int. Cl.[7] ..... A47B 95/00
(52) U.S. Cl. ..... 248/345.1; 5/663; 248/206.3
(58) Field of Search ..... 5/663; 248/345.1, 248/206.3, 205.6

(56) References Cited

U.S. PATENT DOCUMENTS 1,739,801 A * 12/1929 Pitts
2,536,551 A * 1/1951 Johnson ..... 248/345.1
3,049,260 A * 8/1962 Stone
3,936,025 A * 2/1976 Cass ..... 348/345.1
6,019,336 A * 2/2000 Havens ..... 248/345.1

FOREIGN PATENT DOCUMENTS

DE 2048223 * 3/1972 ..... 248/345.1
GB 1181706 * 2/1970 ..... 248/206.3

* cited by examiner

*Primary Examiner*—Alexander Grosz

(57) ABSTRACT

A corner padding attachment device for padding corners which otherwise could cause serious injuries to the occupants including children, in particular. The corner padding attachment device includes an elongate cushion member having a groove being disposed in a longitudinal side thereof and extending a length of the elongate cushion member to pad a corner structure; and also includes suction cup members being spacedly disposed in the groove for fastening the elongate cushion member about the corner structure.

5 Claims, 2 Drawing Sheets

CORNER PADDING ATTACHMENT DEVICE

BACKGROUND OF THE INVENTION

1. Field of the Invention

The present invention relates to corner cushioned attachments and more particularly pertains to a new corner padding attachment device for padding corners which otherwise could cause serious injuries to the occupants including children, in particular.

2. Description of the Prior Art

The use of corner cushioned attachments is known in the prior art. More specifically, corner cushioned attachments heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,072,231; U.S. Pat. No. 4,999,233; U.S. Pat. No. 6,044,601; U.S. Pat. No. 5,639,072; U.S. Pat. No. 4,582,739; and U.S. Pat. No. Des. 411,739.

While these devices fulfill their respective, particular objectives and requirements, the aforementioned patents do not disclose a new corner padding attachment device. The prior art includes cushion members being engaged about the corner structure.

SUMMARY OF THE INVENTION

The general purpose of the present invention, which will be described subsequently in greater detail, is to provide a new corner padding attachment device which has many of the advantages of the corner cushioned attachments mentioned heretofore and many novel features that result in a new corner padding attachment device which is not anticipated, rendered obvious, suggested, or even implied by any of the prior art corner cushioned attachments, either alone or in any combination thereof. The present invention includes an elongate cushion member having a groove being disposed in a longitudinal side thereof and extending a length of the elongate cushion member to pad a corner structure; and also includes suction cup members being spacedly disposed in the groove for fastening the elongate cushion member about the corner structure. None of the prior art includes the combination of the elements of the present invention.

There has thus been outlined, rather broadly, the more important features of the corner padding attachment device in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new corner padding attachment device which has many of the advantages of the corner cushioned attachments mentioned heretofore and many novel features that result in a new corner padding attachment device which is not anticipated, rendered obvious, suggested, or even implied by any of the prior art corner cushioned attachments, either alone or in any combination thereof.

Still another object of the present invention is to provide a new corner padding attachment device for padding corners which otherwise could cause serious injuries to the occupants including children, in particular.

Still yet another object of the present invention is to provide a new corner padding attachment device that is easy and convenient to quickly attach to corners of various structures.

Even still another object of the present invention is to provide a new corner padding attachment device that prevent injuries to people should they come into contact with such corner structures.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
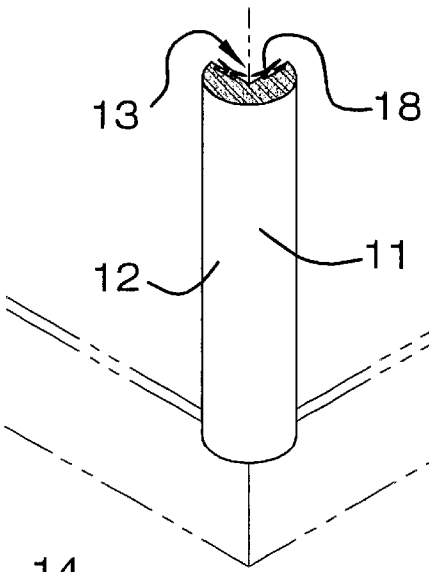
FIG. 1 is a front perspective view of a new corner padding attachment device according to the present invention.
Figure 4:
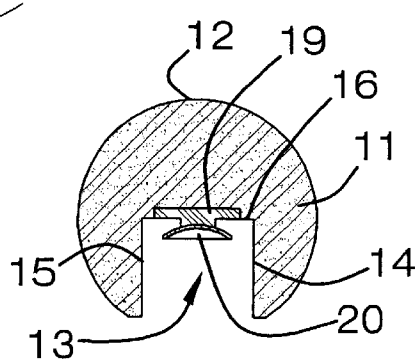
FIG. 4 is a cross-sectional view of a second embodiment of the present invention.
Figure 3:
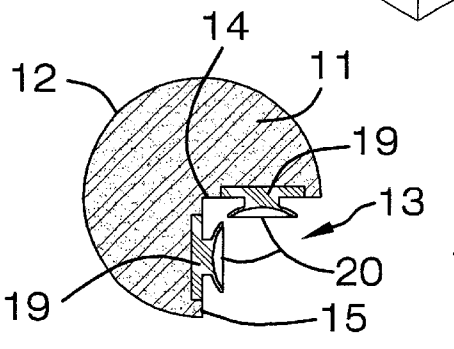
FIG. 3 is a cross-sectional view of the present invention.
Figure 5:
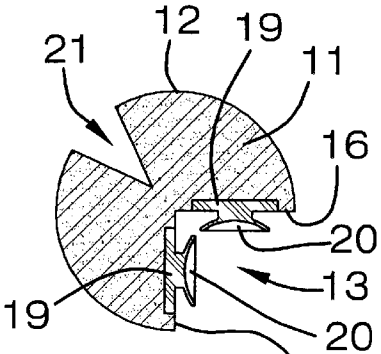
FIG. 5 is a cross-sectional view of a third embodiment of the present invention.
Figure 2:
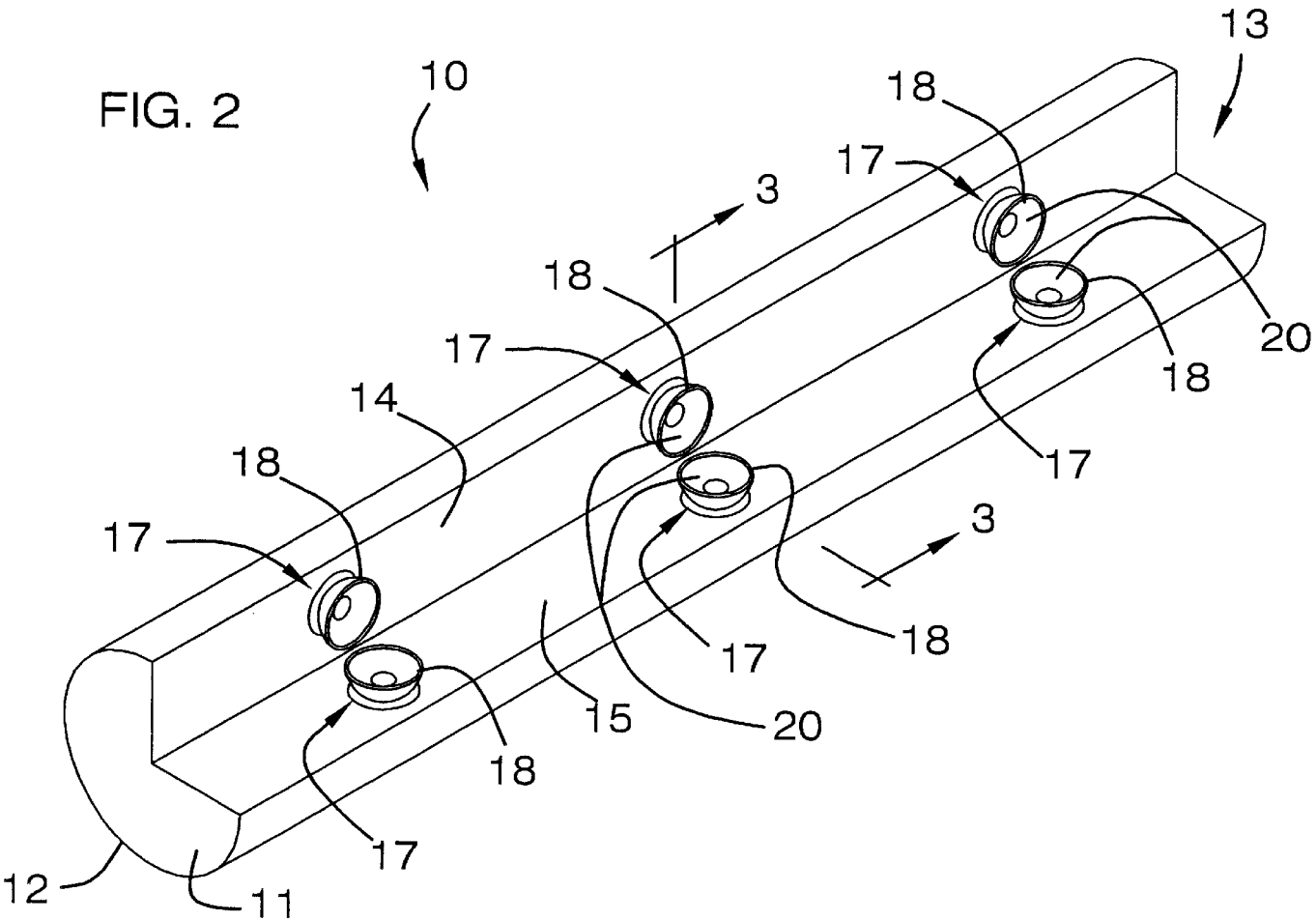
FIG. 2 is a rear perspective view of the present invention.

With reference now to the drawings, and in particular to FIGS. 1 through 5 thereof, a new corner padding attachment device embodying the principles and concepts of the present invention and generally designated by the reference numeral 10 will be described.

As best illustrated in FIGS. 1 through 5, the corner padding attachment device 10 generally comprises an elongate cushion member 11 having a groove 13 being disposed in a longitudinal side thereof and extending a length of the elongate cushion member 11 to pad a corner structure. The elongate cushion member 11 has a laterally rounded longitudinal front side 12 which extends from one longitudinal edge of the groove 13 to an opposed longitudinal edge of the groove 13. The elongate cushion member 11 has longitudinal walls 14–16 forming the groove 13, and also has a plurality of cup-retaining slots 17 being spacedly disposed in one or more of the longitudinal walls 14–16. The longitudinal walls 14, 15 converge to form a generally ninety degree wedge shape.

Suction cup members 18 are spacedly and conventionally disposed in the groove 13 for fastening the elongate cushion member 11 about a corner structure. Each of the suction cup members 18 includes a base 19 having a lateral T-shaped cross-section and being securely and conventionally disposed in a respective one of the cup-retaining slots 17, and also includes a conical-shaped suction cup 20 being conventionally attached to the base 19 and being adapted to attach about the corner structure.

As a second embodiment, the elongate cushion member 11 further includes a longitudinal slot 21 being disposed in the laterally rounded longitudinal front side 12 thereof generally opposite of the groove 13 for attaching the elongate cushion member 11 to sharply-angled corner structures. The longitudinal slot 21 has a generally acutely-angled wedge shape.

As a third embodiment, the groove 13 has a generally U-shaped cross-section with the suction cup members 18 being spacedly attached to the longitudinal wall 16 facing the opening to the groove 13.

In use, the user faces the groove 13 toward the corner structure with the corner structure being disposed in the groove 13 and with the conical-shaped suction cups 18 being securely and removably attached about the corner structure to secure the elongate cushion member 11 to the corner structure.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the corner padding attachment device. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A corner padding attachment device comprising: a elongate cushion member having a groove being disposed in a longitudinal side thereof and extending a length of said elongate cushion member to pad a corner structure;

said elongate cushion member having a laterally rounded longitudinal front side which extends from one longitudinal edge of said groove to an opposed longitudinal edge of said groove;

said elongate cushion member having longitudinal walls forming said groove, and also having a plurality of suction cup retaining slots being spacedly disposed in one or more of said longitudinal walls, and suction cup members being spacedly disposed in said groove for fastening said elongate cushion member about a corner structure, wherein each of said suction cup members includes a base having a lateral T-shaped cross-section and being securely disposed in a respective one of said cup retaining slots, and also includes a conical shaped suction cup being attached to said base and being adapted to attach about the corner structure.

2. A corner padding attachment device as described in claim 1, wherein said longitudinal walls converge to form a generally ninety degree wedge shape.

3. A corner padding attachment device as described in claim 2, wherein said elongate cushion member further includes a longitudinal slot being disposed in said longitudinal front side thereof generally opposite of the groove for attaching said elongate cushion member to sharply-angled corner structures.

4. A corner padding attachment device as described in claim 3, wherein said longitudinal slot has a generally acutely-angled wedge shape.

5. A corner padding attachment device as described in claim 1, wherein said groove has a generally U-shaped cross-section with said suction cup members being spacedly attached to said longitudinal wall facing the opening to said groove.

* * * * *